US010991348B1

(12) United States Patent
Peterson

(10) Patent No.: US 10,991,348 B1
(45) Date of Patent: Apr. 27, 2021

(54) METHOD AND APPARATUS FOR PICK TECHNIQUE

(71) Applicant: Lyle Peterson, Osoyoos (CA)

(72) Inventor: Lyle Peterson, Osoyoos (CA)

( * ) Notice: Subject to any disclaimer, the term of this patent is extended or adjusted under 35 U.S.C. 154(b) by 0 days.

(21) Appl. No.: 16/953,314

(22) Filed: Nov. 19, 2020

(51) Int. Cl.
*G10D 3/173* (2020.01)

(52) U.S. Cl.
CPC ..... *G10D 3/173* (2020.02)

(58) Field of Classification Search
CPC ..... G10D 3/173
See application file for complete search history.

(56) References Cited

U.S. PATENT DOCUMENTS 3,789,720 A * 2/1974 McIntyre ..... G10D 3/173 84/322
4,015,502 A * 4/1977 Strong ..... G10D 3/173 84/322
4,102,234 A 7/1978 Brundage
4,122,746 A * 10/1978 Freeman ..... G10D 3/173 84/322
4,137,814 A * 2/1979 Rowley ..... G10D 3/173 84/322
4,270,433 A * 6/1981 Adamec ..... C07F 9/4075 84/322
5,413,020 A 5/1995 Thompson
D362,264 S 9/1995 Trees
D397,716 S 9/1998 Mulkins
D397,717 S 9/1998 Mulkins
D397,718 S 9/1998 Mulkins
5,973,243 A * 10/1999 Christenson ..... G10D 3/173 84/322
6,118,058 A * 9/2000 Rowley ..... G10D 3/173 84/320
6,127,613 A * 10/2000 Hansel ..... G10D 3/173 84/332
6,977,330 B2 * 12/2005 Santa Cruz ..... G10D 3/173 84/322
D626,170 S 10/2010 McNeely
8,017,845 B2 * 9/2011 Slingsby ..... G10D 3/173 84/320
8,492,630 B1 * 7/2013 Wonnacott ..... G10D 3/173 84/320
D712,454 S 9/2014 Koster
9,240,167 B2 1/2016 Caccia
9,997,145 B1 * 6/2018 Rubenstein ..... G10D 3/173
10,074,349 B2 9/2018 Spivey et al.
10,706,826 B1 * 7/2020 Sweeney ..... G10D 3/173
2009/0139384 A1 * 6/2009 Bramucci ..... G10D 3/173 84/322
2009/0229442 A1 * 9/2009 Hollin, Jr. ..... G10D 3/173 84/322
2014/0076120 A1 * 3/2014 Hollin, Jr. ..... G08G 5/06 84/322
2014/0197216 A1 * 7/2014 Bortree ..... G10D 3/173 224/267

* cited by examiner

*Primary Examiner* — Robert W Horn

(57) ABSTRACT

An illustrated view of an exemplary guitar pick for strumming guitar strings is presented. The guitar pick is useful for always being in a proper place for strumming the guitar strings. The guitar pick is further easy to place on one's finger and to use. The guitar pick is further efficient in costs.

12 Claims, 3 Drawing Sheets

METHOD AND APPARATUS FOR PICK TECHNIQUE

FIELD OF THE INVENTION

This invention relates to musical instruments. More particularly, it relates to accessories for playing a musical instrument.

BACKGROUND

The guitar is a fretted musical instrument that usually has six strings. It is typically played with both hands by strumming or plucking the strings with either a guitar pick or the fingers/fingernails of one hand, while simultaneously fretting (pressing the strings against the frets) with the fingers of the other hand. The sound of the vibrating strings is projected either acoustically, by means of the hollow chamber of the guitar (for an acoustic guitar), or through an electrical amplifier and a speaker.

The guitar is a type of chordophone, traditionally constructed from wood and strung with either gut, nylon or steel strings and distinguished from other chordophones by its construction and tuning. The modern guitar was preceded by the gittern, the vihuela, the four-course Renaissance guitar, and the five-course baroque guitar, all of which contributed to the development of the modern six-string instrument.

There are three main types of modern acoustic guitars: the classical guitar (Spanish guitar/nylon-string guitar), the steel-string acoustic guitar and the archtop guitar, which is sometimes called a "jazz guitar", The tone of an acoustic guitar is produced by the strings' vibration, amplified by the hollow body of the guitar, which acts as a resonating chamber. The classical guitar is often played as a solo instrument using a comprehensive finger-picking technique where each string is plucked individually by the player's fingers, as opposed to being strummed. The term "finger-picking" can also refer to a specific tradition of folk, blues bluegrass, and country guitar playing in the United States. The acoustic bass guitar is a low-pitched instrument that is one octave below a regular guitar.

A "guitar pick" or "plectrum" is a small piece of hard material generally held between the thumb and first finger of the picking hand and is used to "pick" the strings. Though most classical players pick with a combination of fingernails and fleshy fingertips, the pick is most often used for electric and steel-string acoustic guitars. Though picks today they are mainly plastic, variations do exist such as bone, wood, steel or tortoise shell. Tortoise shell was the most commonly used material in the early days of pick-making, but as tortoises and turtles became endangered, the practice of using their shells for picks or anything else was banned. Tortoise-shell picks made before the ban are often coveted for a supposedly superior tone and ease of use, and their scarcity has made them valuable.

Picks come in many shapes and sizes. Picks vary from the small jazz pick to the large bass pick. The thickness of the pick often determines its use. A thinner pick (between 0.2 and 0.5 mm) is usually used for strumming or rhythm playing, whereas thicker picks (between 0.7 and 1.5+ mm) are usually used for single-note lines or lead playing.

Thumb picks and finger picks that attach to the fingertips are sometimes employed in finger-picking styles on steel strings. These allow the fingers and thumb to operate independently, whereas a flat pick requires the thumb and one or two fingers to manipulate.

When using a pick to play the guitar, banjo or any other stringed instrument, the pick sometimes moves out of position or is inaccurately placed in the proper position to play the stringed instrument. Therefore, the pick is not placed into the proper position to utilize the guitar pick.

Accordingly, in light of the foregoing, there is a need for a device to provide easier use of a pick for playing a stringed instrument and ease of placement in the proper position for playing.

DETAILED DESCRIPTION

Figure 1A:
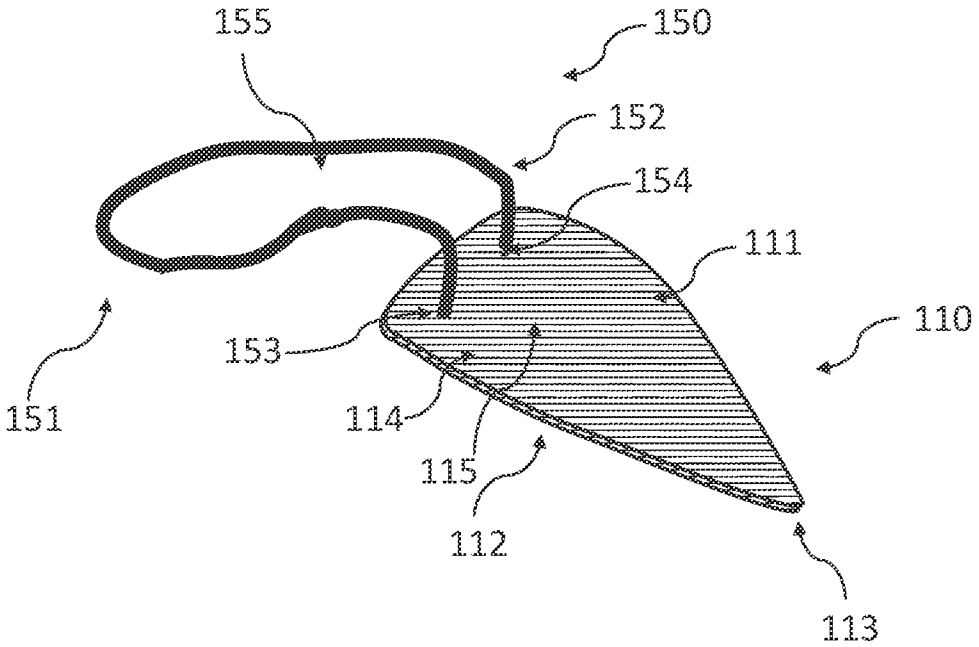
FIG. 1A is an illustrated view of an exemplary guitar pick.

The phrases "in one embodiment," "in various embodiments," "in some embodiments," and the like are used repeatedly. Such phrases do not necessarily refer to the same embodiment. The terms "comprising," "having," and "including" are synonymous, unless the context dictates otherwise. Such terms do not generally signify a closed list.

"Above," "adhesive," "affixing," "any," "around," "both," "bottom," "by," "comprising," "consistent," "customized," "enclosing," "friction," "in," "labeled," "lower," "magnetic," "marked," "new," "nominal," "not," "of," "other," "outside," "outwardly," "particular," "permanently," "preventing," "raised," "respectively," "reversibly," "round," "square," "substantial," "supporting," "surrounded," "surrounding," "threaded," "to," "top," "using," "wherein," "with," or other such descriptors herein are used in their normal yes-or-no sense, not as terms of degree, unless context dictates otherwise.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications and equivalents. In alternate embodiments, additional devices, or combinations of illustrated devices, may be added to, or combined, without limiting the scope to the embodiments disclosed herein.

Figure 1B:
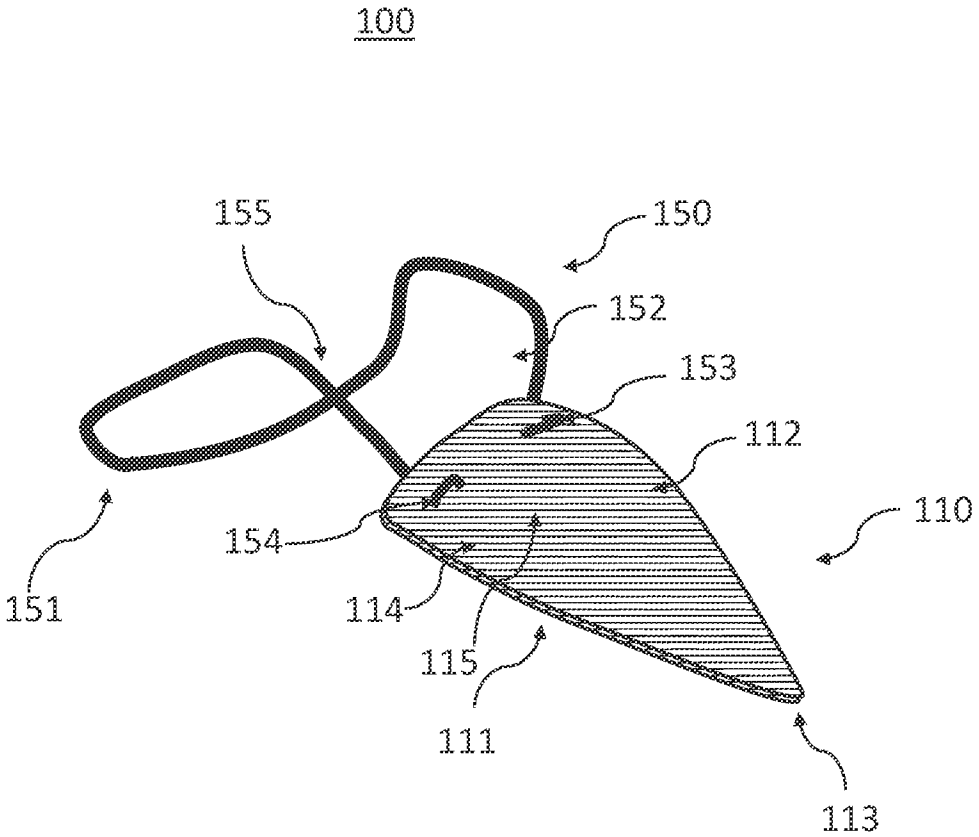
FIG. 1B is an illustrated view of a bottom of the guitar pick shown in FIG. 1A.

Referring to FIG. 1A and FIG. 1B, an illustrated view of an exemplary guitar pick 100 for strumming guitar strings is presented. The guitar pick 100 is useful for always being in a proper place for strumming the guitar strings. The guitar pick 100 is further easy to place on one's finger and to use. The guitar pick 100 is further efficient in costs.

The guitar pick 100 has a pick 110 and a bracket 150. The pick 110 has a top 111, a bottom 112 and a strumming end 113. The strumming end 113 of the pick 110 of the guitar pick 100 is configured to make contact with and strum a string of a guitar.

The pick 110 is preferably made of a plastic material, such as nylon, Delrin, celluloid, etc., however other materials are hereby contemplated, including, but not limited to, rubber, felt, tortoiseshell, wood, metal, glass, tagua, stone. The guitar pick 110 is preferably an acute isosceles triangle where two equal corners rounded and a third corner less rounded, other shapes are hereby contemplated, including, but not limited to, shark's fin pick, shark's edge pick.

The bracket 150 has a first side 151, a second side 152, an opening 155 and a coupling device 153. The coupling device 153 is coupled to the pick 110 by inserting the coupling device 153 through the bottom 112 of the pick 110 in two positions 114, 115 exiting the top 111 of the pick 110. The coupling device 153 further has a curved or bent portion 154 on the top 111 of the pick 110 to secure the bracket 150 to the pick 110.

In FIG. 1A, a first end 153 of the bracket 150 is inserted into a top 111 of the pick 110 significantly near the back 157 of the pick 150. The second end 154 of the bracket 150 is inserted into the top 111 of the pick 110 significantly near the back 157 of the pick 150. The first end 153 and the second end 154 of the bracket 150 extends through the pick 110 and is coupled to the bottom 112 of the pick 110 to secure the bracket 150 to the pick 110.

The bracket 150 is preferably made of a plastic material, such as nylon, Dekin, celluloid, etc., however other materials are hereby contemplated, including, but not limited to, rubber, felt, aluminum, etc.

Figure 2:
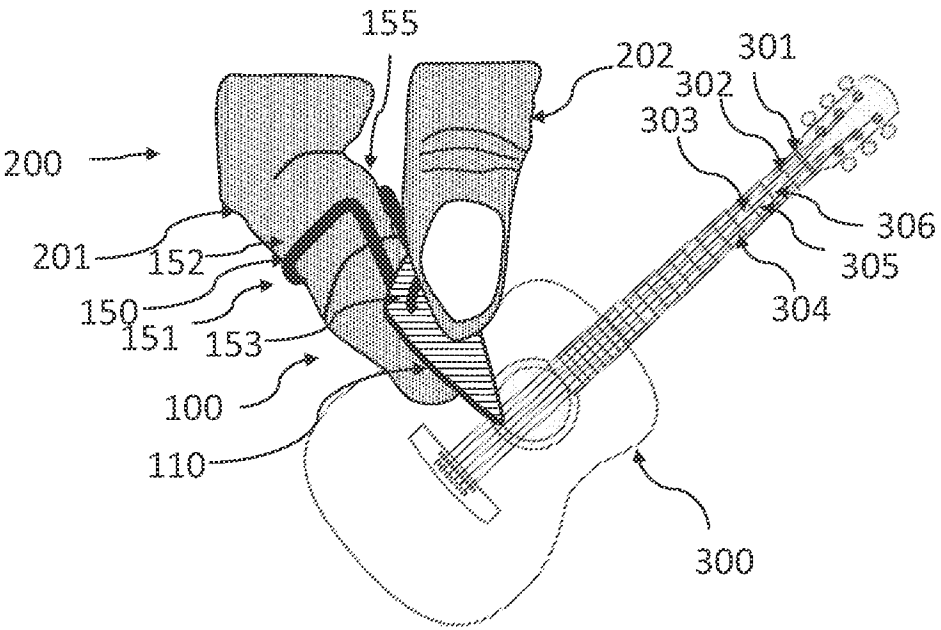
FIG. 2 is an illustrated use of the exemplary guitar pick shown in FIG. 1A.

Moving now to FIG. 2, an illustrated use of the exemplary guitar pick shown in FIG. 1 is presented. Once the coupling device 152 of the bracket 150 has been installed onto the pick 110, a user places a hand 200 with one or more fingers 201, 202 substantially near the second side 152 of the bracket 150.

The user inserts one of the fingers 201 into the bracket 150 at an opening 155 allowing access to the second side 152 of the bracket 150 until the bracket 150 is securely coupled to the finger 201.

Once the bracket 150 is securely coupled to the finger 201, the guitar pick 100 is adjusted to a proper position. The user then strums one or more strings 301, 302, 303, 304, 305, 306 of a guitar 300. After completing playing the guitar 300, the user can remove the finger 201 from the bracket 150 for further use and storage of the guitar pick.

In the numbered clauses below, specific combinations of aspects and embodiments are articulated in a shorthand form such that (1) according to respective embodiments, for each instance in which a "component" or other such identifiers appear to be introduced (with "a" or "an," e.g.) more than once in a given chain of clauses, such designations may either identify the same entity or distinct entities; and (2) what might be called "dependent" clauses below may or may not incorporate, in respective embodiments, the features of "independent" clauses to which they refer or other features described above.

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

The features described with respect to one embodiment may be applied to other embodiments or combined with or interchanged with the features of other embodiments, as appropriate, without departing from the scope of the present invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A guitar pick for proper placement of a pick, the guitar pick comprising:

a pick, the pick having a top, a bottom, a strumming portion and a plurality of holes; and a wire-like bracket, the bracket having a coupling device, a first side and a second side, the second side having an opening for placement of a finger, the coupling device being inserted through the plurality of holes, wherein the coupling device having a curved portion for securing the bracket in place.

2. The guitar pick of claim 1, wherein the pick being made of a plastic material.

3. The guitar pick of claim 2, wherein the plastic material being nylon.

4. The guitar pick of claim 1, wherein the pick having an acute isosceles triangle shape.

5. The guitar pick of claim 1, wherein the bracket being made of a plastic material.

6. The guitar pick of claim 5, wherein the plastic material being nylon.

7. A method for providing proper placement of a pick for playing a guitar, the method comprising:

coupling a bracket of a guitar pick to the pick;

placing a finger at an opening of a second side of the bracket; and inserting the finger into the bracket where the bracket being securely coupled to the finger.

8. The method of claim 7, wherein the pick being made of a plastic material.

9. The method of claim 8, wherein the plastic material being nylon.

10. The method of claim 7, wherein the pick having an acute isosceles triangle shape.

11. The method of claim 7, wherein the bracket being made of a plastic material.

12. The method of claim 11, wherein the plastic material being nylon.

* * * * *